United States Patent [19]

Klausen

[11] Patent Number: 4,838,995

[45] Date of Patent: Jun. 13, 1989

[54] PROCESS FOR BLEACHING CELLULOSE PULP, A PLANT FOR PREFORMING SAID PROCESS, AND A SCREW PRESS FOR USE WITH SAID PROCESS AND PLANT

[75] Inventor: Arne I. Klausen, Sande, Norway

[73] Assignee: Thune-Eureka A/S, Tranby, Norway

[21] Appl. No.: 7,564

[22] Filed: Jan. 28, 1987

[30] Foreign Application Priority Data

Oct. 23, 1986 [NO] Norway ..... 864241

[51] Int. Cl.[4] ..... D21C 9/00

[52] U.S. Cl. ..... 162/18; 162/24; 162/45; 162/56; 162/57; 162/59; 162/234; 162/243; 162/246; 162/248; 162/251; 210/209; 210/211; 210/523; 241/200.1

[58] Field of Search ..... 162/18, 24, 56, 241, 162/246, 234, 45, 57, 59, 243, 248, 251; 210/209, 211, 212, 523; 241/260.1; 8/156; 68/181 R

[56] References Cited

U.S. PATENT DOCUMENTS 2,355,091 8/1944 McDonald ..... 162/56 X

*Primary Examiner*—Peter Chin
*Assistant Examiner*—Thi Dang
*Attorney, Agent, or Firm*—Young & Thompson

[57] ABSTRACT

For bleaching cellulose pulp or a fraction thereof, e.g. reject pulp, the cellulose pulp or fraction, having a concentration of 0.5–10%, preferably 3–6%, is introduced into a screw press comprising at least a first (47) and a second (48) dewatering zone, is dewatered in the first zone to a concentration of 20–40%, whereupon a liquor of bleach chemicals is introduced centrally into the pulp which, during continued treatment, is dewatered in the second zone to a discharge pulp concentration of 15–50, preferably 15–30%, the liquid pressed out of the second zone, together with fresh bleach chemicals, being returned to the pulp in the screw press as liquor of bleach chemicals.

5 Claims, 6 Drawing Sheets

PROCESS FOR BLEACHING CELLULOSE PULP, A PLANT FOR PREFORMING SAID PROCESS, AND A SCREW PRESS FOR USE WITH SAID PROCESS AND PLANT

A process for bleaching cellulose pulp or a fraction thereof, a plant for use in carrying out said process, and a screw press, especially for use with said process and plant.

The present invention relates to a process for bleaching cellulose pulp or fractions thereof, e.g. reject pulp.

The invention also relates to a plant for use in carrying out the process according to the invention, comprising a device for addition and admixture of bleaching chemicals to a cellulose pulp or fractions thereof.

Furthermore, the invention relates to a screw press, especially for use in carrying out said process, or in said plant according to the invention.

Washing cellulose pulp gains more and more importance as regards purity, spots, and brightness. In the production of bleached chemical pulp great efforts were made for a long time in the washer room in order to achieve a minimum of chemicals transgressing from one step to another, and in this manner to achieve good economy of chemicals.

As regards unbleached chemical pulp it is equally important for certain groups of products to wash out impurities. An example of such a group of products to be mentioned here is unbleached cardboard for milk cartons.

In the high yield pulp area, i.e. pulp with a high lignin content, bleached mechanical or chemi-mechanical pulp is used more and more instead of fully bleached mechanical pulp for several product areas, e.g. tissue, cardboard, and various kinds of writing and printing paper. This interest in high yield pulp is not only due to the price of mechanical pulp, but also to the fact that this kind of pulp shows considerably improved property profiles, e.g. opacity, and density, as compared with chemical fibres. High bulk of high yield pulp, i.e. low density, will result in high ridigity, a property often aimed at and advantageous, e.g. in packings to be stacked.

Problems with high yield pulp as opposed to chemical pulp were mainly connected with two factors. One is brightness, and the other removing extractive substances by washing. The chemical character of extractive substances, being in part deleterious to the absorbency of tissue and fluff, and in part auto-oxidative, disintegration to low molecular evil-smelling substances will result. In this connection, we refer to Swedish patent application No. 80 06410-8. With the technology known today, especially in connection with bleached chemi-mechanical pulp, washing is now so efficient, that absorbency and velocity of absorption are fully comparable with chemical pulp.

As regards bleaching of high yield pulp there is a clear trend towards carrying out the bleaching process with increasing pulp concentrations. First and foremost, the object in this connection is to be able to reduce costs of chemicals. There is a definite relationship beween consumption of bleaching chemicals in the peroxide bleaching process and impure pulp in the form of released organic matter, so called COD, and metals naturally present in the wood, e.g. iron and manganese.

Metals are complexed by suitable complexing agents, e.g. diethylenetriamine penta acetic acid (DTPA). The technique is known, inter alia from Swedish patent application No. 7705073-0. However, complexing of the metals is not sufficient. They must also be washed out before bleaching. It is a common opinion in the trade that a complexed metal remaining with the pulp is almost more dangerous than non-complexed metal to the peroxide in bleaching. In other words, it is most essential that the pulp is very thoroughly washed before the bleaching process starts.

Another important reason why bleaching should be carried out with high pulp concentrations is that the level of brightness of the pulp is increased by bleaching in a number of steps and at high pulp concentrations, at the same time as it was possible to maintain costs of chemicals at a reasonable level. In this manner it is possible to bleach high yield pulp to a brightness of more than 80% ISO, determined according to Scan-standards.

The great disadvantage in connection with bleaching of highly concentrated material, the dry solids content of the pulp in the bleaching tower being 17% or more, arises in connection with the admixture of chemicals. Furthermore, it should be kept in mind that the higher the pulp concentration at a certain temperature the quicker bleaching is carried out.

It should also be pointed out that the bleaching technique commonly used today for higher brightness is carried out with a bleaching tower, not with a bleaching refiner.

The state of technology as regards admixture of chemicals in cases of high pulp concentration of more than 20% is comprehensive, as exampled below:

1. Dosing of chemicals occurs in an ordinary screw conveyor. The pulp will in this case form lumps or balls. It is necessary to supply much water with the chemicals, resulting in low pulp concentrations. Incomplete mixing will often result.

2. A screw conveyor provided with shovels and several recesses in the periphery of the screw blade may be used. In this case, too, it is necessary to add and distribute much water with the chemicals. The result of admixture is better than in case of 1 above, but nevertheless, not satisfactory in this connection.

3. A rod mixer may be used and will have a fairly satisfactory effect for up to 17% pulp concentration, but above this concentration a rod mixer is not suitable.

4. A slotted mixer has a very satisfactory effect up to pulp concentrations of 17%. Additionally, a pump for pressurized pulp is needed in front of the slotted mixer, due to the great pressure drop occurring in the mixer. This means en increased capital investment.

5. Kneaders comprising two parallel screws are on the market from several manufacturers. Such machinery is bulky and in this case, as well, it is necessary to disperse water with the chemicals and, thus, bleaching in case of a pulp concentration of 25% or more will demand much from the dewatering equipment before admixture. An addition of water in an order of 400–500 l/ton pulp will be necessary. If chemicals are added in a concentrated form the peroxide will disintegrate.

6. Fluffer mixer. This kind of mixer is useful for pulp concentrations of more than 20% but bad for lower concentrations because the pulp will tend to "adhere". Additionally it is necessary to add water with the chemicals in this case too. The demands on the equipment are, thus, even greater than as mentioned under item 5.

7. High consistency refiner or screw and/or push refiners may be used. An example to be mentioned is a FROTA-PULPER®. This is a useful mixer for high solids content and it is also useful for pulp concentrations below 20%. Capital investment and operating costs, however, will be high when this mixer is used.

None of the mixers mentioned above can be used for washing equipment at the same time.

8. Another method for admixture of chemicals is the method disclosed in Swedish patent application No. 77.04404-8, wherein a large proportion of recirculated and temperature controlled bleaching chemicals are mixed with the lignocellulose material with a pulp concentration of 2–15%, preferably 8–12%, and is then, within 300 sec., preferably within 50 sec. dewatered to a pulp concentration of 18–50%, preferably 20–32%. The object of this known method is, thus, in part to achieve an efficient mixture of chemicals and pulp and, in part, a simultaneous possibility of controlling the temperature. Because of the subsequent pressurizing step, in which the pulp is dewatered to 18–50% pulp concentration, preferably to 20–32%, this method differs from the mixer variants discussed under items 1–7, also in that the pulp will pass through an additional washing step before it arrives at the bleaching tower. Capital investment is, thus, high with this method, as compared to the above mentioned mixer variants.

The bleaching chemicals are water soluble, i.e. they remain with the water phase. With the last mentioned method, thus, very high amounts of residual chemicals are present in the process circuit. Furthermore, after a certain period of time in the process circuit released organic low molecular sugars are concentrated via the second process step and the hazard of peroxide disintegration is, thus, great and highly likely.

Also, the beginning of bleaching is achieved at a pulp concentration of 2–15%, preferably 8–12%, i.e. this is not a case of high concentration. This last mentioned method, thus, has two disadvantages, as seen from a bleaching view. In the first place large amounts of released substance are formed in the loop, and in the second place, extremely high concentrations of chemicals are required in the loop, which means that there will be large amounts of chemicals in the pulp after the second pressurizing step, from which the pulp goes to the bleaching tower, i.e. there is a great hazard of peroxide disintegration. Also, the beginning of bleaching does not occur at a high concentration.

It is a special object of the invention to provide a process which in one and the same step, carried out in a screw press, will result in dewatering, washing, and admixture of chemicals at a high pulp concentration. Thus, an improved economy of chemicals, more pure and homogeneous product properties, and the possibility of using new process impregnations of specific fibre groups, e.g. reject pulp, with chemicals may be achieved. According to the invention a process for bleaching cellulose pulp or fractions thereof, e.g. reject pulp, is proposed, said process being characterized by the fact that cellulose pulp or a fraction thereof, having a concentration of 0.5–10%, preferably 3–6%, is introduced into a screw press comprising at least a first and a second dewatering zone, is dewatered in said first zone to a concentration of 20–40%, after which a bleach liquor of chemicals is added centrally to the pulp, which during continued treatment is dewatered in said second zone to a discharge pulp concentration of 15–50%, preferably 15–35%, the liquid pressed out from said second zone, together with fresh bleach liquor being returned to the pulp in the screw press as bleach liquor.

The invention also relates to a plant for use in carrying out said new method. Said plant comprises a device for adding and mixing bleach liquor to/with a cellulose pulp or fractions thereof, said plant being characterized by the fact that said device is a screw press with at least a first and a second dewatering zone, and by the fact that said plant comprises a device for central introduction of a bleach liquor to said pulp after said first zone, a device for collecting the liquid pressed out from said second zone and for returning said liquid to the pulp in said screw press as a bleach liquor through said central supply device, and a device for supplying fresh bleach liquor to said return means.

According to the invention said central return means, advantageously, comprises a longitudinal bore in the screw press shaft, extending from one shaft end to the area of said second washing zone, and nozzles or holes from said bore outwards to the exterior surface of said shaft in the last mentioned area.

The invention also relates to a screw press, primarily developed for use in the plant according to the invention and for carrying out the process according to the invention. Said screw press is unique and, thus, is of independent inventive value.

The present invention, thus, implies that in one and the same screw press, the dewatering, washing, and introduction of chemicals with a high discharging pulp concentration are achieved. The incoming pulp has a concentration of 0.5–10%, preferably 3–6%, and is introduced into said screw press in a conventional manner, e.g. by pumping. Said pulp is dewatered in a first zone or primary zone. A liquor of chemicals is pumped into the shaft bore of said screw press and will emerge through nozzles or holes in the periphery of said screw shaft, at a place where the pulp is already dewatered in said first zone (primary zone). The introduced liquor of chemicals will act as a washing liquor supplied at a place in said screw press where the pulp concentration is approx. 20–40%, preferably approx. 25–35%. The liquor of chemicals or bleach liquor will displace the liquid present in the pulp, i.e. washing is carried out, and at the same time the fibres will be impregnated with chemicals during an active screw conveyance and pushing of the pulp forwards to the last portion of said press, an efficient admixture of chemicals with fibre pulp being, thus, achieved. Dewatering from this step, i.e. said second zone or secondary zone, will yield chemicals that are collected and returned to the shaft bore of said screw press, together with added fresh chemicals.

With the present invention several advantages are achieved, as compared with the prior art:

(a) low capital cost, because one screw press step is sufficient and a separate mixer is not needed;

(b) the volume of machinery will be small, i.e. the invention is easily applicable to an older system;

(c) a high degree of washing efficiency is achieved with reference to machine cost and volume;

(d) the plant, or the screw press, respectively, will act as an admixer of chemicals as well as the above mentioned known special equipment variants;

(e) the discharge pulp concentration from said screw press will be high, i.e. 15–50%, preferably 15–30%;

(f) due to the fact that chemicals are added to the pulp at a place where the dry solids content is high the amount of released organic substance will be low and, furthermore, the content of chemicals in the pressed out water from the secondary zone will be low, with resulting low risk of peroxide disintegration in the return loop, provided that there is a good process arrangement in front of said screw press, i.e. that complexing agents are added to an oridnary degree;

(g) the invention enables novel process impregnation with chemicals of specific fibre groups, e.g. reject pulp. Reject pulp often contains a higher portion of bark particles and impurities, e.g. phenolic acids, inter alia, containing higher metal proportions as well as organic matter consuming hydrogen peroxide, as compared with the accepted stock. In this connection, it is most important to have a well washed pulp so that good admixture of chemicals may be achieved. A subsequent treatment, e.g. in a refiner, will have the best effect if the dry solids content is high, because the lowest fibre cutting is then also achieved. Maximum strength and a low content of chips may, thus, be achieved with such treatment. Use of chemicals with sodium hydroxide (NaOH) and hydrogen peroxide ($H_2O_2$) for reject pulp will be more advantageous than no treatment with chemicals, e.g. more brightness, a considerably lower content of chips, and well fibrillated fibres ensuring strength.

In the drawings

Figure 1:
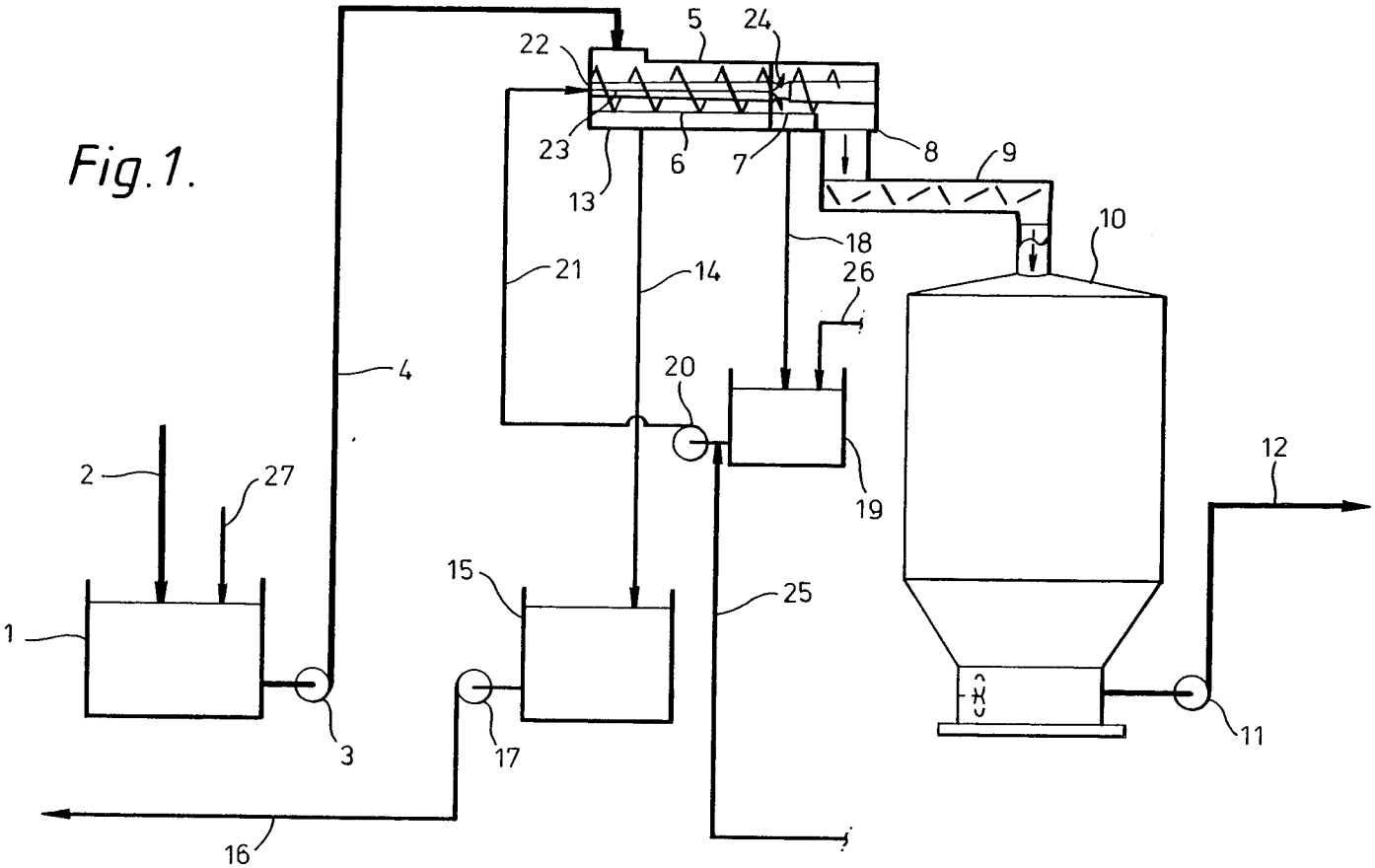
FIG. 1 is a flow chart of a possible process plant according to the invention.

The plant shown in FIG. 1 comprises a pulp chest 1 to which cellulose pulp is supplied through a conduit 2. From pulp chest 1 a conduit 4, provided with a pulp pump 3 extends to inlet casing of a screw press 5. Screw press 5 is designed with a first zone 6, a second zone 7, and a discharge casing 8, from which a screw conveyor 9 extends to a bleaching tower 10. From said bleaching tower 10 a conduit 12, with an inserted pulp pump 11, extends to a not shown place of consumption of bleached cellulose pulp, or to an additional dewatering step for recovering non-used bleach chemicals.

In the first zone 6 of the screw press the pressed-out liquid is collected in a collecting chamber 13 and goes from there through a conduit 14 to a white water vessel 15. From white water vessel 15 there is a conduit 16 provided with a pump 17, as shown.

From second zone 7 of the screw press collected pressed-out liquid goes through a conduit 18 to a washing vessel 19. From washing vessel 19 a conduit 21, provided with a pump 20, extends to the screw shaft 22 of said screw press, more precisely, to a longitudinal bore 23 in said screw shaft. Said bore 23 extends through said screw shaft 22 to said second zone 7, and it opens in the periphery of said press screw through nozzles or holes, as indicated with arrows 24. A conduit 25 from a stock of bleach chemicals, not shown, opens into conduit 21, up-stream of pump 20. Through said conduit 25 fresh chemicals are supplied to the return loop for bleach chemicals formed by conduit 21 and bore 23. A pipe 26 from a white water tank or fresh water store, not shown, opens into washing liquid vessel 19. Also, a pipe 27 from a stock of chemicals, not shown, opens into pulp chest 1.

A process according to the invention may, e.g. be carried out in the plant shown in FIG. 1 in the following manner: Cellulose pulp is supplied to pulp chest 1 through conduit 2. From pulp chest 1 pulp is pumped by pump 3 and pressed through conduit 2, e.g. with a consistency of 5%. The pulp is supplied to the inlet casing of screw press 5 and in said first zone of the screw press it will be dewatered to a pulp concentration of approx. 33%. The white water is collected in vessel 13 and goes through conduit 14 to white water vessel 15. From this white water vessel the white water is pumped through conduit 16 back to the process upstream of the bleaching means where it is, preferably, used for dilution. Portions of this white water may, if desired, go to pulp chest 1 and/or portions may go to a suitable outlet to remove part of the impurities that are washed out of the pulp in first zone 6 of the screw press. As mentioned above, such impurities often consist of released organic matter (COD), and certain metals, e.g. manganese and iron. To simplify removal of such impurities by washing in first zone 6 of the screw press, complexing agents, e.g. diethylene triamine penta acetic acid (DTPA), are added to pulp chest 1 through pipe 27.

After dewatering in first zone 6 the pulp, having been concentrated to 33%, is provided with a bleach liquor in second screw press zone 7. This liquor arrives from container 19 through conduit 21, and through central bore 23 in screw shaft 22. Said bore 23, as mentioned, opens in second zone 7 through nozzles or holes 24 in screw shaft 22. In second zone 7 dewatering occurs simultaneously, and pressed out liquor which will have a high content of bleach chemicals, goes through conduit 18 to liquor vessel 19. From there the liquor returns to zone 7 through conduit 21, bleach chemicals being added to a necessary degree through conduit 25 and white water or fresh water being added through conduit 26. In the discharge casing 8 of the press the pulp will have a concentration of, e.g. 27%. From outlet 8 of the press the pulp goes through screw conveyor 9 to a bleaching tower 10, from which the pulp after spreading is pumped by pump 11 through conduit 12 to a place of consumption, not shown.

Figure 2:
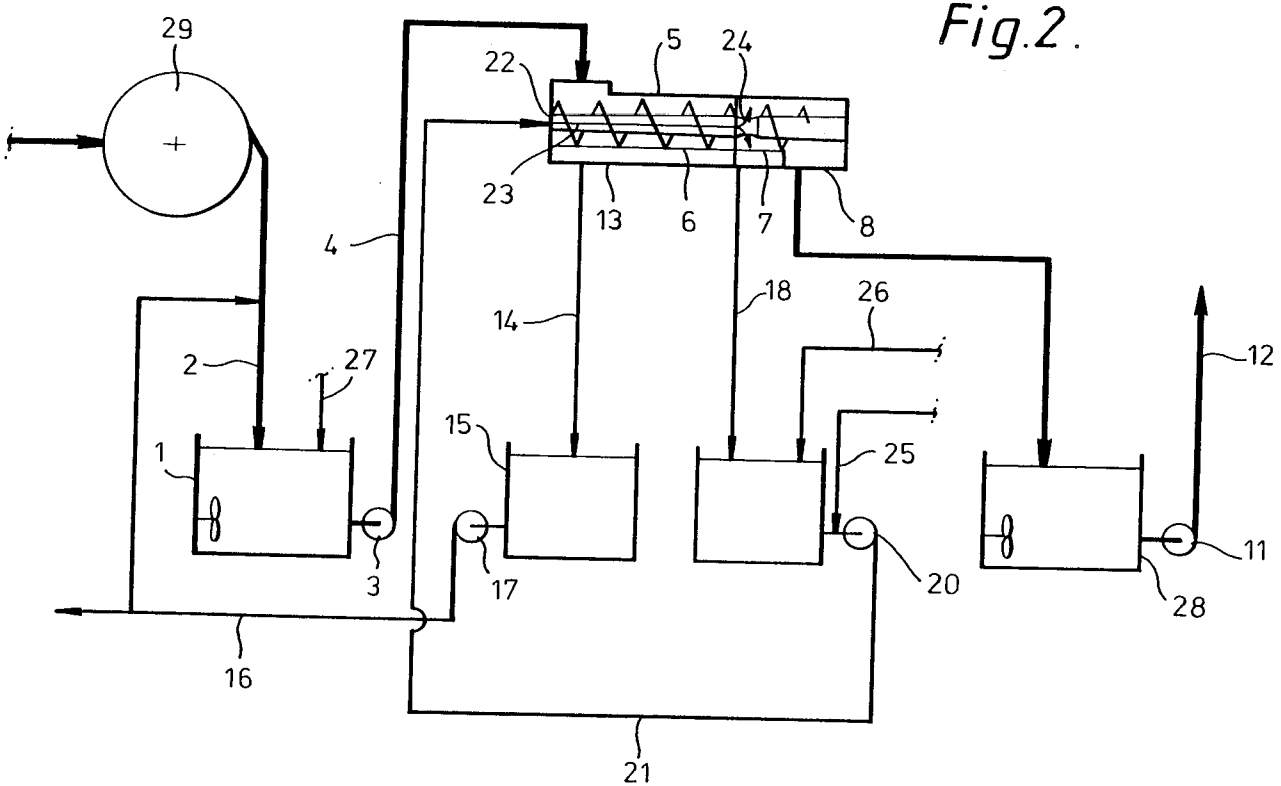
FIG. 2 shows a full scale test plant for testing the invention.

The process plant shown in FIG. 2 differs from that shown in FIG. 1 only by having screw conveyor 9 and bleaching tower 10 repalced by a pulp chest 28. The same reference numbers are, thus, used for those components of the plant that are common to plants according to FIGS. 1 and 2. As opposed to what is the case in the plant according to FIG. 1, pulp arrives from a disk filter 29 having a consistency of approx. 15% and falls down into pulp chest 1. When the pulp leaves press 5 it falls directly down into pulp chest 28 to be pumped further in the system.

Figure 3:
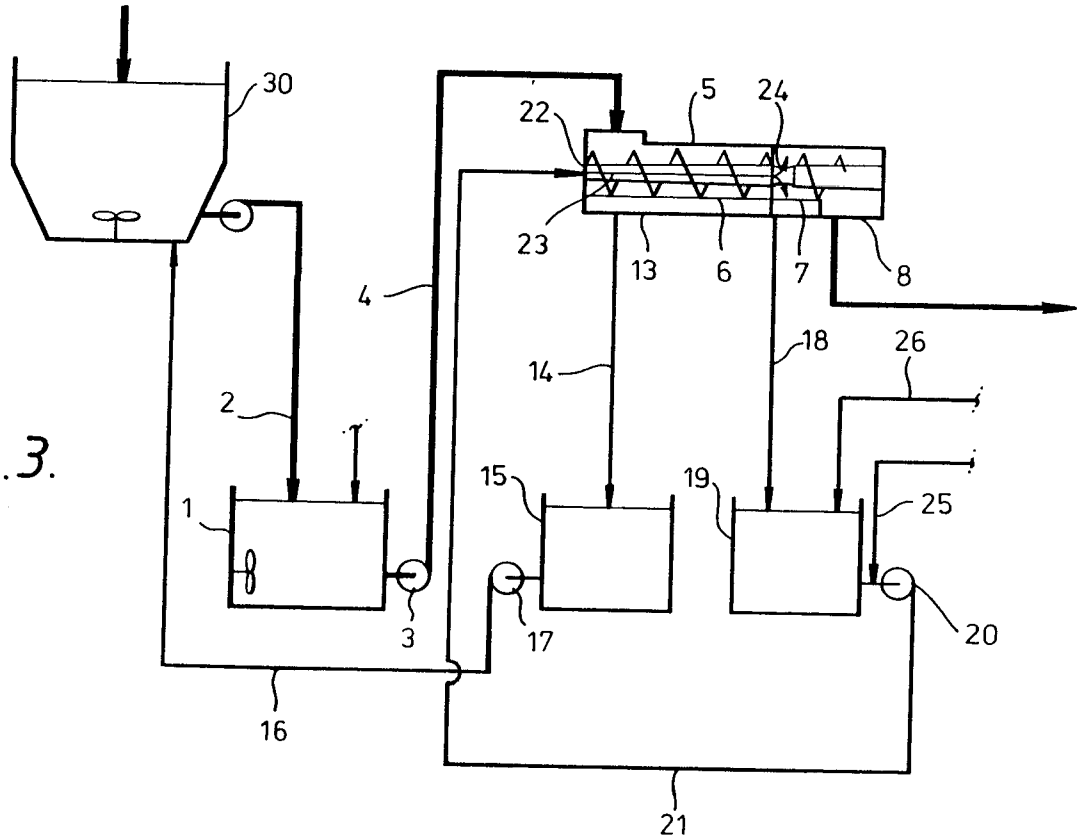
FIG. 3 shows the same test plant installed in a deinking plant for recycling papers and magazines, the screw press being installed immediately before the bleaching tower.

The process plant shown in FIG. 3 largely corresponds to that of FIG. 2. The plant shown in FIG. 3 is representative for a test plant installed in a deinking plant for recycled papers and magazines. Since the screw press is installed immediately up-stream of the bleaching tower (not shown), pulp chest 28 is omitted here. In FIG. 3 a container 30 is shown instead of disk filter 29 in FIG. 2.

Figure 4:
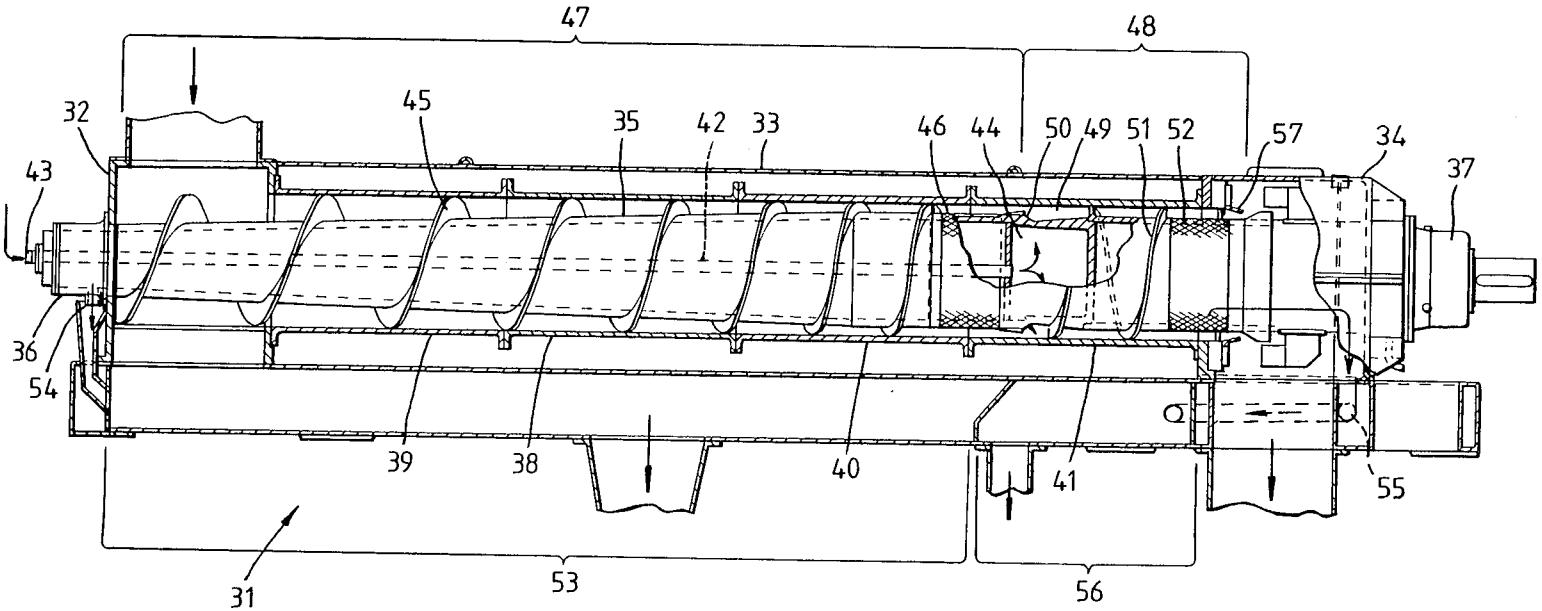
FIG. 4 is a longitudinal section of a preferred embodiment of a screw press according to the invention.

The screw press shown in FIG. 4 is a central element of the bleaching plant.

Screw press 31 comprises an inlet casing 32 followed by a screw casing 33 with a connected discharge pipe 34. A press screw 35 is rotatably mounted in inlet casing 32 and discharge casing 34, respectively, in bearings 36 and 27, respective. In screw casing 33 press screw 35 is encompassed by a screen mantle comprised of four screen pipes 38, 39, 40, and 41. As shown, press screw 35 is hollow and is provided with an internal pipe 42 extending in the axial direction and opening at 43. Pipe 42 opens into a partitioned void 44 in the press screw. The surface of said press screw on which a blade 45 is provided is imperforate from said inlet to a screen plate 46 forming the termination of a first dewatering zone 47, corresponding to the shown first zone 6 in FIGS. 1, 2, and 3. Then follows a second dewatering zone 48, corresponding to second zone 7 in FIGS. 1, 2, and 3. In the first portion of second dewatering zone 48 of said screw press said press screw 35 comprises a throated portion 49, i.e. blade 45 is lacking and the cross section of said press screw is smaller than at the outlet of said first dewatering zone 47. In said throated portion 49 several holes 50 communicate with void 44. Closely following the last screw blade 51 said press screw is provided with a second screen plate 52. The liquid pressed out through screen plate 52 goes to collecting vessel 56 through channel 55. The cellulose pulp arrives in inlet casing 32 of said screw press and is conveyed by blade 45 of said press screw to the outlet of said first dewatering zone 47 of the press.

The liquid pressed out of the pulp in said first dewatering zone 47 partly goes out through screen pipe 39,40 and partly goes into press screw 35 through screen plates 46 on the surface of said press screw. Inside said press screw the liquid is guided towards the inlet end of said press screw, where at 54 it is introduced into a collecting vessel 53 together with the liquid arriving from the screen pipe. The liquid or white water, as it is often called, is then conducted away from the collecting vessel through outlet opening 55. When the cellulose pulp arrives at said outlet of said first dewatering zone 47, it is dewatered to a very high dry solids content (20–40%) due to compression by said press screw.

In said first portion of second dewatering zone 8 of the screw press said press screw, as mentioned, comprises a throated portion, i.e. there is no press screw blade and the press screw cross section is smaller than at the outlet of said first dewatering zone. In this throated portion of said press screw a series of holes 50 communicate with said press screw void 44. From said void 44 pipe 42 extends through the center of said press screw and opens at the end of screw shaft in said inlet casing 32, 36 of the screw press.

Through said pipe 42 a mixture of chemicals is dosed in through holes 50 and is mixed with said cellulose pulp. This admixture is easily achieved by pumping the chemicals into said throated portion 49 where the pulp expands and will easily suck up liquid. At the same time the pumping pressure on the chemical liquor will provide for a displacement of the amount of liquid remaining in the pulp from first dewatering zone and out through screen pipe 41.

The cellulose pulp forms a homogeneous pulp plug in the throated portion of the press screw that is called admixture zone 49. Said screw portion lacks a feed blade and said pulp is fed only by the aid of the pushing force from screw blade 45 in said first dewatering zone 47. At the outlet of said admixture zone the cellulose pulp again is influenced by screw blade 51 providing for conveyance of said pulp through the last portion of second dewatering zone 48.

Apart from said admixture zone 49 the press screw shows increasing compression in second dewatering zone 48. Due to this fact most of the added chemicals liquor is pressed out through screen pipe 41 and through screen plate 52 that is provided on the surface of said press screw, closely after the last screw blade. The liquid pressed out through screen plate 52 into the interior of the screw is evacuated through suitable channels 55 down into a collecting vessel 56 where it is mixed with the liquor of chemicals/white water pressed out through screen pipe 14.

From collecting vessel 56 the liquid goes to liquid vessel 19, as mentioned in the disclosure of the process as shown in FIG. 1. The dewatering occurring in the last portion of second dewatering zone 48 is considered most important in order to achieve an efficient admixture of chemicals in admixture zone 49. With high pressure and great pushing forces on the pulp said pulp is penetrated by this liquor of chemicals and practically every fibre is contacted with said chemicals.

When said pulp has passed through the screw portion provided with screen plate 52 the final dry solids content is determined by the adjustment of the counter pressure system 57.

Below, we will give some examples of the new process. Examples 1 and 2 refer to the process plant as shown in FIGS. 2 and 5.

Figure 5:
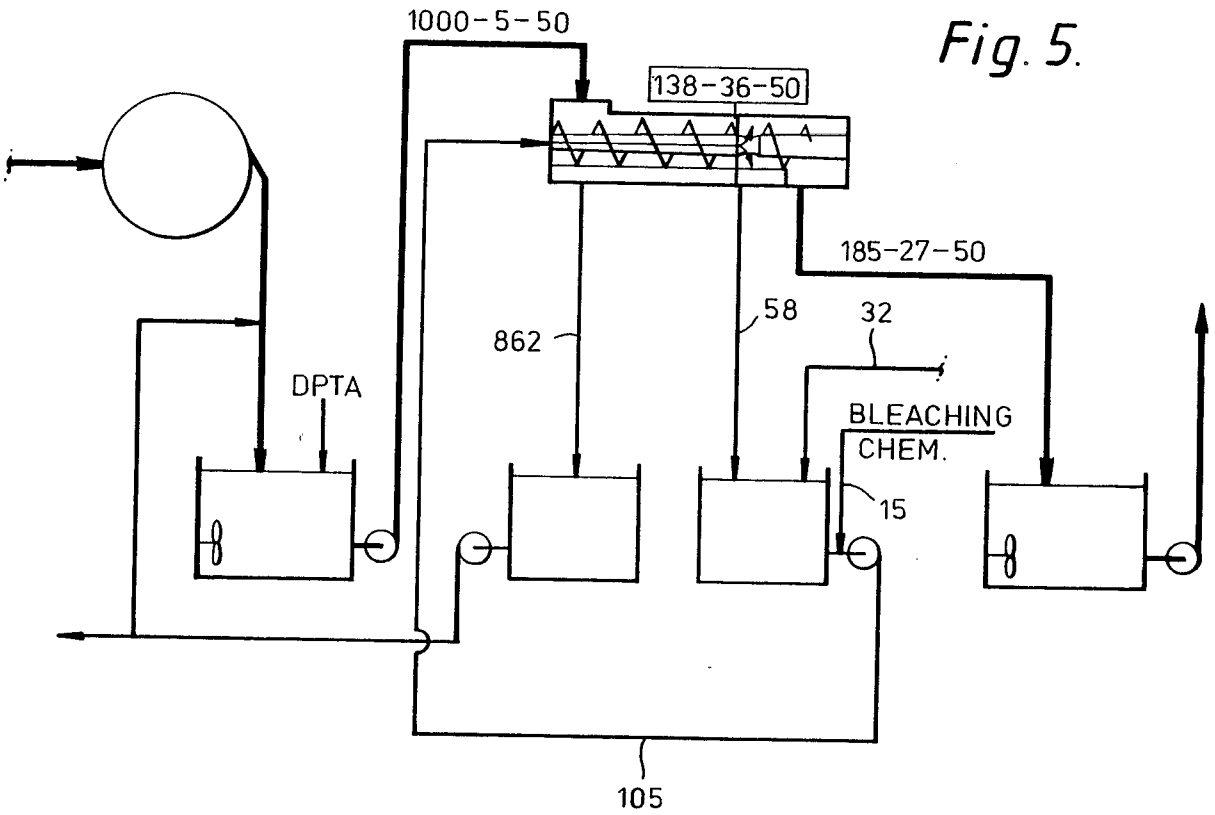
FIG. 5 shows the plant of FIG. 2 with separate pulp flows indicated.

FIG. 5 shows the separate pulp flows indicated with amounts of 1/min., pulp consistency in %, and the production through said plant in kg/min. (100% dry substance).

For the white water flows only amounts of 1/min. are stated. The fibre content of the white water was low (approx. 1.5 g/l) and, thus, we can ignore it in this connection.

EXAMPLE 1

Unbleached CTMP-pulp (chemi-thermomechanical pulp) of spruce was run through the process plant with a production of 80 tons (90%) a day=(50 kg/min. 100%).

Freeness: 300 ml CSF

Temperature: 75° C.

The brightness of the pulp was measured to 60° ISO before the bleaching test was started. In the first partial test the following amounts of chemicals were used:

12.5 kg/ton (100%) hydrogen peroxide-$H_2O_2$ (100% $H_2O_2$)

32.0 kg/ton (100%) water glass-$Na_2SiO_2$ (commodity 40° Be)

5.6 kg/ton (100%) sodium hydroxide-NaOH

These chemicals were added at the inlet of pump 20 that dosed said chemicals into the pulp in admixture zone 49 of the press (FIG. 4). 5 kg/ton (90%) complexing agent DTPA was added to pulp chest 1 up-stream of the screw press. Pulp samples were taken downstream of the screw press and they were bleached in the lab under controlled circumstances. The brightness, pH, and the content of residual peroxide ($H_2O_2$) were measured immediately after sampling after one hour and after bleaching for two hours.

The results showed:

| Bleaching time (hours) | pH | Residual peroxide g/l | Brightness °ISO |
|---|---|---|---|
| 0 | 9.1 | 1.7 | 64.6 |
| 1 | 8.9 | 0.6 | 68.6 |

-continued

| Bleaching time (hours) | pH | Residual peroxide g/l | Brightness °ISO |
|---|---|---|---|
| 2 | 8.5 | 0.4 | 70.1 |

During this test the pH and residual peroxide values were measured as 10.0 and 3.6 g/l, respectively in the loop for recirculating chemicals and white water 21. The relatively low pH of the pulp at the outlet of the press indicates that too little liquor (NaOH) was used in the test and that this reduced the brightness a little.

EXAMPLE 2

During the next partial test the addition of chemicals was increased to the following values:

$H_2O_2$: 44 kg/ton (100%)

$Na_2SiO_3$: 44 kg/ton (100%)

NaOH: 18 kg/ton (100%)

After bleaching the pulp in the lab the following results were obtained:

| Bleaching time (hours) | pH | Residual peroxide g/l | Brightness °ISO |
|---|---|---|---|
| 0 | 10.7 | 5.9 | 68.7 |
| 1 | 9.6 | 3.2 | 76.1 |
| 2 | 9.3 | 3.1 | 76.2 |

This time the pH and the peroxide content were also measured in the circuit for recirculating chemicals. The measurements showed: pH: 10.8, peroxide content 14.3 g/l.

The results show that this CTMP pulp after bleaching will contain large amounts of non-consumed bleaching chemicals when using the present invention. By using a known bleaching technique these may be returned to the bleaching tower and, thus, increased brightness of the pulp may be achieved, or a lower supply of chemicals may be achieved for the same brightness.

EXAMPLE 3

Figure 6:
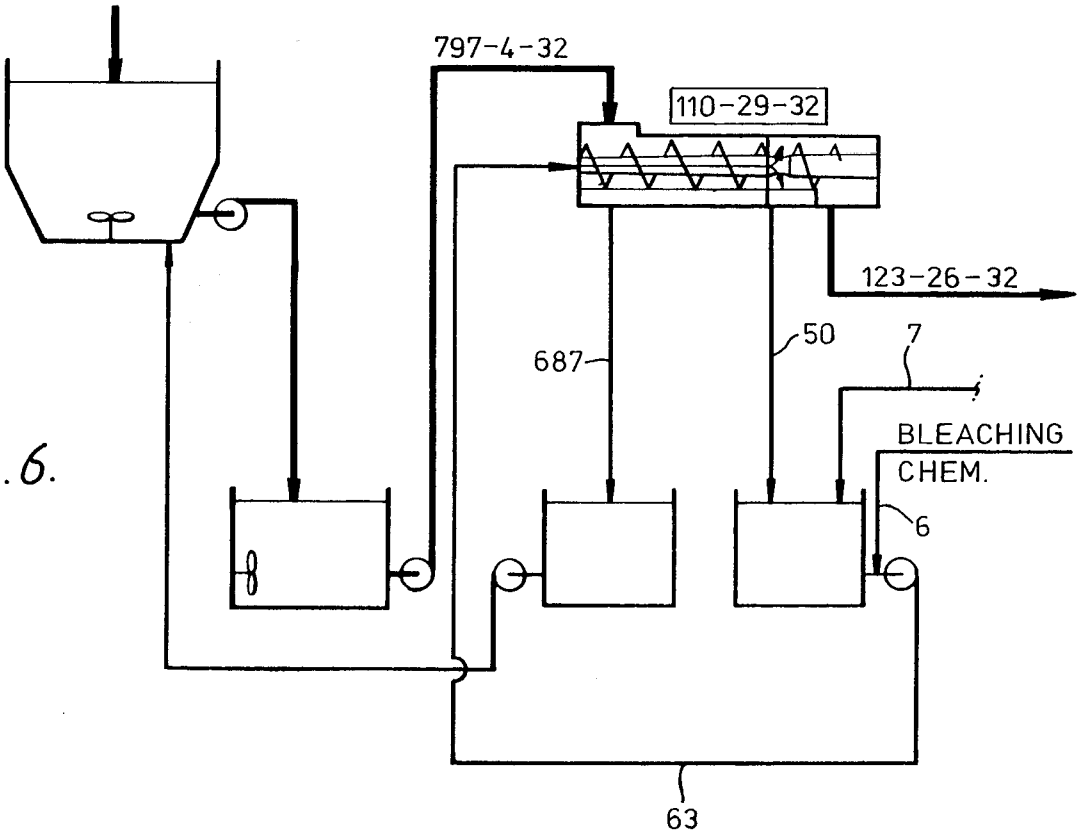
FIG. 6 shows the plant of FIG. 3 with separate pulp flows indicated.

This Example describes trial runs with the plant shown in FIGS. 3 and 6.

The pulp mixture was 80% recycled papers and 20% magazines. The temperature was 44° C. and the freeness of pulp was 150 ml CSF (Canadian standard freeness).

This time the screw press was installed to precede the peroxide bleaching tower and side-by-side with existing equipment for dewatering and admixture of chemicals. The test plant received pulp from the same pump 3 that supplied the other press means (screen belt presses), and during the test equal amounts of bleach chemicals were supplied to both bleaching systems.

Pulp samples were taken downstream of the screw press and of the mixer (rod mixer) in the existing system. The pulp samples were bleached in the lab under controlled circumstances (50° C. water bath for 2 hours).

In this deinking plant the bleaching tower is succeeded by a flotation plant and, thus, the pulp samples were also subjected to flotation before the brightness was measured.

The following amounts of chemicals were used during the test:

9.0 kg/ton (100%)-hydrogen peroxide $H_2O_2$ (100%)

13.0 kg/ton (100%)-water glass $Na_2SiO_3$-(commodity 50° BE)

Pulp samples taken in chest 1 preceding the bleaching means showed a brightness of 46° ISO. There proved to be an increase of brightness of 6–7 units after bleaching for two hours (in a 50° C. water bath).

All samples showed that higher brightness of the pulp was achieved from the screw press than from samples taken downstream of the mixer (approximately 0.5–1.0 unit). The pulp from the screw press also contained twice as much residual peroxide as did the pulp from the mixer and this indicates that bleach chemicals may be saved when the invention is used.

Having described my invention, I claim:

1. A process for bleaching cellulose pulp or fractions thereof, comprising introducing material comprising cellulose pulp or fractions thereof having a concentration of 0.5–10% by weight into a screw press having a screw supported on a screw shaft having a longitudinal bore providing communication between an inlet and outlet longitudinally displaced from one another along said screw shaft, said screw press comprising at least a first and a second dewatering zone through which said screw shaft extends, said outlet of said screw shaft positioned within said second dewatering zone, dewatering said material in said first zone to a concentration of 20–40% by weight, feeding a bleach liquor to said inlet of said screw shaft to treat the pulp in said second zone of said screw press, further dewatering said treated pulp in said second zone to a pulp concentration of 15–50% by weight, recovering any liquid removed from the pulp during dewatering in said second zone, and mixing said liquid with fresh bleach chemicals to form an admixture of bleach liquor which is subsequently fed to the inlet of said screw shaft.

2. A plant for use in bleaching material comprising cellulose pulp or fractions thereof, comprising means for adding bleach chemicals to and mixing said chemicals with said material, said means comprising a screw press having a screw means, said screw means including a longitudinal bore, said screw press comprising means for defining a first and a second dewatering zone, means for recovering any liquor removed from said pulp in said second zone and means for returning said recovered liquor to the pulp in said second zone in said screw press through said longitudinal bore of said screw means, and means for admixing fresh bleach chemicals with said recovered liquor.

3. A plant as claimed in claim 2, in which said longitudinal bore provides communication between an inlet end of said screw means and an outlet in said second zone, and said outlet comprised of openings through which said liquor emerges from said screw means in said second zone.

4. A screw press comprising a casing, a press screw mounted for rotation in said casing, and a screen surrounding said press screw, said press having means defining a first and a second dewatering zone through which material to be pressed successively passes and through which said press screw extends, a longitudinal passage in said screw extending from an inlet end of said screw through said first zone and opening into said second zone, and means for feeding any liquor recovered from said second zone through said passage through said first zone and into said second zone.

5. A screw press as claimed in claim 4, wherein said longitudinal passage opening into said second zone is positioned in a portion of said screw having a reduced diameter.

* * * * *